US010774451B2

(12) United States Patent
Stanhope et al.

(10) Patent No.: US 10,774,451 B2
(45) Date of Patent: Sep. 15, 2020

(54) FLAME RESISTANT FABRIC HAVING WOOL BLENDS

(71) Applicant: Southern Mills, Inc., Union City, GA (US)

(72) Inventors: Michael T. Stanhope, Atlanta, GA (US); Charles S. Dunn, Griffin, GA (US)

(73) Assignee: Southern Mills, Inc., Union City, GA (US)

( * ) Notice: Subject to any disclaimer, the term of this patent is extended or adjusted under 35 U.S.C. 154(b) by 99 days.

(21) Appl. No.: 14/707,438

(22) Filed: May 8, 2015

(65) Prior Publication Data

US 2015/0322598 A1 Nov. 12, 2015

Related U.S. Application Data

(60) Provisional application No. 61/990,430, filed on May 8, 2014.

(51) Int. Cl.
*D04B 1/04* (2006.01)
*D03D 15/12* (2006.01)
(Continued)

(52) U.S. Cl.
CPC ..... *D03D 15/12* (2013.01); *D03D 27/08* (2013.01); *D04B 1/04* (2013.01); *D04B 1/123* (2013.01);
(Continued)

(58) Field of Classification Search
CPC ..... B32B 3/10; B32B 5/00; B32B 5/02
See application file for complete search history.

(56) References Cited

U.S. PATENT DOCUMENTS 4,958,485 A 9/1990 Montgomery et al.
5,727,401 A 3/1998 Statham
(Continued)

FOREIGN PATENT DOCUMENTS

CN 102449214 5/2012
JP H03-000837 A 1/1991
(Continued)

OTHER PUBLICATIONS

International Search Report and Written Opinion, PCT Application No. PCT/US15/29839, dated Jul. 22, 2015.
(Continued)

*Primary Examiner* — Jennifer A Chriss
*Assistant Examiner* — Ricardo E Lopez
(74) *Attorney, Agent, or Firm* — Kilpatrick Townsend & Stockton LLP

(57) ABSTRACT

A flame resistant fabric includes first yarns including inherently flame resistant fibers and second yarns including wool fibers. The fabric may satisfy one or more performance standards set forth in ASTM F 1506-02, NFPA 2112 and NFPA 70E. The fabric may be a knit or woven fabric, such as a plush or terry knit construction, and one or both sides of the fabric may be napped to form a fleece fabric. The second yarns may include wool and modacrylic fibers, or wool fibers and other inherently flame resistant fibers. The first yarns or second yarns may include sufficient inherently flame resistant fibers such that the fabric has a char length of no more than 4 inches and an afterflame of no more than 2 seconds when tested in accordance with ASTM D6413. The fabric may exhibit a thermal shrinkage of no more than 10% when tested in accordance with NFPA 2112.

2 Claims, 1 Drawing Sheet

(51) Int. Cl.
*D03D 27/08* (2006.01)
*D04B 1/12* (2006.01)

(52) U.S. Cl.
CPC ..... *D10B 2211/02* (2013.01); *D10B 2321/08* (2013.01); *D10B 2331/021* (2013.01); *D10B 2403/0111* (2013.01); *D10B 2403/0114* (2013.01); *D10B 2403/0121* (2013.01); *D10B 2501/04* (2013.01); *Y10T 428/2395* (2015.04); *Y10T 428/249921* (2015.04); *Y10T 442/3984* (2015.04); *Y10T 442/40* (2015.04)

(56) References Cited

U.S. PATENT DOCUMENTS

| | | | | |
|---|---|---|---|---|
| 6,131,419 | A * | 10/2000 | Rock | D04B 1/02 28/162 |
| 8,389,100 | B2 | 3/2013 | Rock et al. | |
| 8,536,076 | B1 | 9/2013 | Byles | |
| 8,703,631 | B2 | 4/2014 | Sytz | |
| 9,091,020 | B2 | 7/2015 | Li et al. | |
| 9,370,212 | B2 | 6/2016 | Zhu | |
| RE46,443 | E | 6/2017 | Terrell | |
| 9,706,804 | B1 | 7/2017 | Emery et al. | |
| 9,745,674 | B2 | 8/2017 | Hines et al. | |
| 9,782,947 | B2 | 10/2017 | Gunzel et al. | |
| 2005/0255771 | A1 | 11/2005 | Chetty et al. | |
| 2006/0292953 | A1* | 12/2006 | Ashley | A41D 31/0022 442/197 |
| 2007/0044286 | A1 | 3/2007 | Nohara | |
| 2007/0101771 | A1 | 5/2007 | Wildeman et al. | |
| 2008/0214081 | A1* | 9/2008 | Quednau | A41D 31/0022 442/414 |
| 2009/0019614 | A1 | 1/2009 | Hagihara et al. | |
| 2009/0042474 | A1 | 2/2009 | Lin et al. | |
| 2009/0049579 | A1* | 2/2009 | Roberts | D04B 1/126 2/81 |
| 2010/0003880 | A1* | 1/2010 | Byles | D04B 1/16 442/318 |
| 2010/0033880 | A1 | 2/2010 | Dimitrov et al. | |
| 2010/0285285 | A1* | 11/2010 | Winterhalter | D02G 3/047 428/196 |
| 2013/0055490 | A1 | 3/2013 | Zhu | |

FOREIGN PATENT DOCUMENTS

| | | | | |
|---|---|---|---|---|
| JP | H09-9250052 | A | 9/1997 | |
| JP | 11315451 | A * | 11/1999 | |
| JP | 2001329464 | A * | 11/2001 | |
| JP | 2007-023463 | A | 2/2007 | |
| JP | 2007077537 | A * | 3/2007 | |
| JP | 2014-208930 | A | 11/2014 | |
| WO | WO-0000686 | A1 * | 1/2000 | D02G 3/443 |
| WO | 2004002254 | | 1/2004 | |
| WO | 2011090848 | | 7/2011 | |
| WO | 2014/025601 | A1 | 2/2014 | |

OTHER PUBLICATIONS

International Preliminary Report on Patentability, PCT Application No. PCT/US15/29839, dated Nov. 17, 2016.
AU 2015255859, "First Examination Report," dated Mar. 29, 2018, 4 pages.
CN 201580036980.3, "Office Action," dated Nov. 1, 2017, 20 pages (13 pages of English Translation, 7 pages of Chinese Translation).
EP 15789471.8, "Extended European Search Report," dated Dec. 15, 2017, 8 pages.
CN 201580036980.3, "Office Action," dated Jun. 14, 2018, 14 pages.
Office Action, Brazilian Patent Application No. 112016025874-6, dated Apr. 7, 2020, 6 pages.
Japanese Patent Application No. 2016-566799 , Office Action, dated Jun. 4, 2019, 9 pages.
Australian Patent Application No. 2018247356, First Examination Report, dated Nov. 27, 2019, 2 pages.
Chinese Patent Application No. 201580036980.3, Office Action, dated Oct. 8, 2019, 13 pages.

* cited by examiner

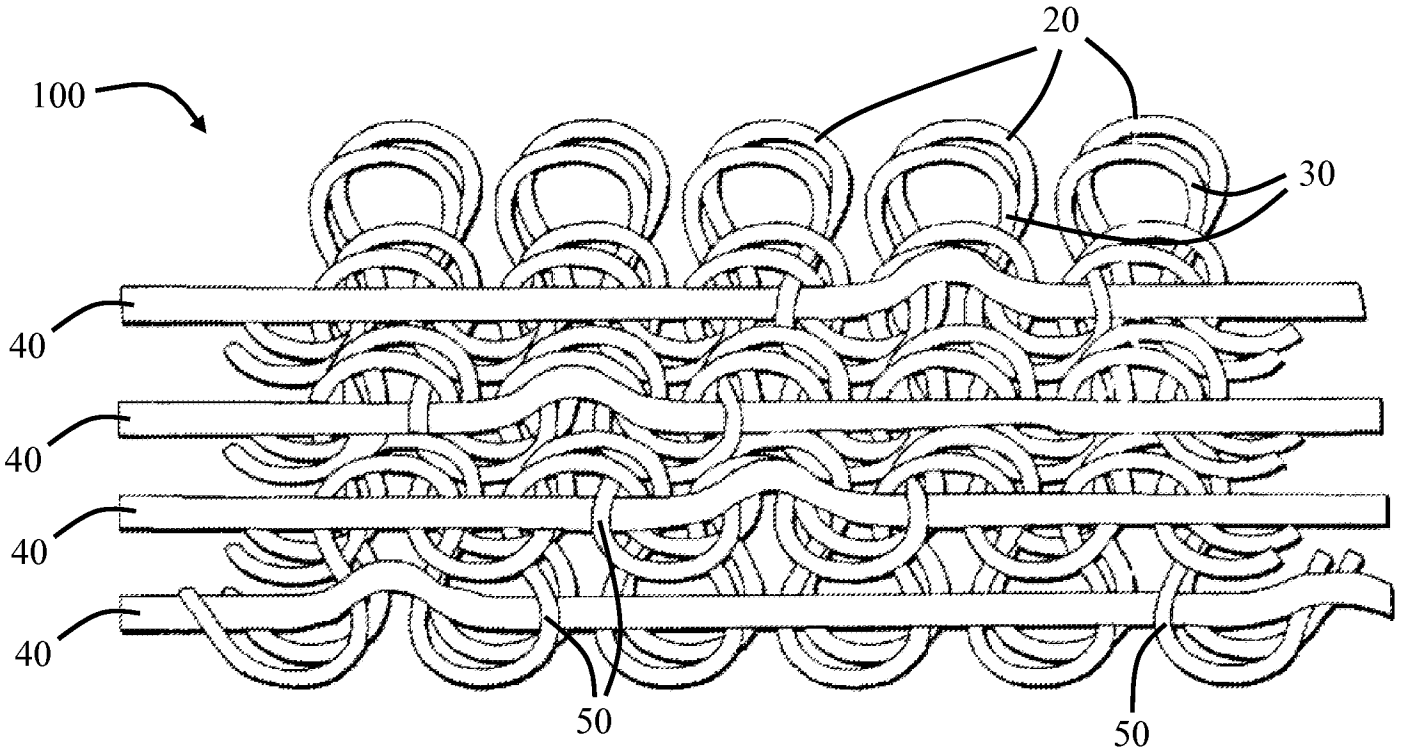
100
20
30
40
40
40
40
50
50

FLAME RESISTANT FABRIC HAVING WOOL BLENDS

RELATED APPLICATION

The present application claims the benefit of U.S. Provisional Patent Application No. 61/990,430, filed May 8, 2014, the disclosure of which is incorporated herein by this reference in its entirety.

FIELD OF THE INVENTION

The present disclosure relates generally to flame resistant fabrics, and more particularly to flame resistant fabrics including yarns containing blends of wool.

BACKGROUND

Knitted fleece fabrics have been used for cold weather insulation either in standalone garments or garment components. These fleece fabrics are usually made with polyester or cotton fiber on plush/terry, or 2-end, 3-end or similar knitting machines. The fabric is then napped and sometimes sheared to make the pile. A pile surface can be formed on one or both sides of the fabric. Typically, 2-end and 3-end fabrics are napped on only one side of the fabric and plush/terry fabrics may be napped on one or both sides of the fabric. These fabrics may contain different fibers in the pile yarn and in the ground/stitch yarn and, if a 3-end knit, in the tie yarn of the fabric. See U.S. Pat. No. 5,727,401, the entirety of which is incorporated by reference. The resilient polyester fiber is low cost, a good insulator, launderable with good appearance and insulation characteristics, hydrophobic, still insulative when wet, and quick drying. These characteristics are all helpful for good performance in cold weather clothing.

There is a need for cold weather insulating materials for workers who may be exposed to flash fires, other thermal exposures, and arcs in the course of performing their jobs. Employees in the petro-chemical and electrical utility areas frequently work outdoors and face both flash fire and electrical arc thermal threats. They need thermally resistant cold weather insulation garments.

Unfortunately, polyester fleece burns and melts upon exposure to the types of thermal threats encountered in those occupations. This of course presents a potential danger to wearers of polyester and other non-thermally resistant fleece materials. Efforts have been made to produce flame resistant fleece fabrics, but they have been based on aramid fiber which is difficult to dye and in many cases prohibitively expensive. Other flame resistant fleece material has high (>50%) levels of modacrylic fibers, which, although less expensive than aramid fibers, have some negative characteristics. Many of those modacrylic fabrics tend to have poor pile loft and poor afterwash appearance. The poor pile loft, especially after laundering, may result in lower insulation levels for a given weight of material. The poor appearance may be the result of either matting or pilling of the modacrylic fiber surface. The modacrylic fiber is simply not stiff or resilient enough to make good pile. In addition, these modacrylic blends have high thermal shrinkage (>10%) and high char length (>4 inches) and thus typically will not satisfy the requirements of NFPA 2112.

SUMMARY

The terms "invention," "the invention," "this invention" and "the present invention" used in this patent are intended to refer broadly to all of the subject matter of this patent and the patent claims below. Statements containing these terms should not be understood to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to the entire specification of this patent, all drawings and each claim.

Embodiments of the invention relate to a flame resistant fabric including first yarns and second yarns, the first yarns including inherently flame resistant fibers and the second yarns including wool fibers.

In some embodiments, the flame resistant fabric satisfies one or more performance standards set forth in ASTM F 1506-02, NFPA 2112 (2012) and NFPA 70E (2012).

In certain embodiments, the fabric is a knit fabric. In other embodiments, the fabric is a woven fabric.

The inherently flame resistant fibers may include aramid fibers, such as para-aramid and/or meta-aramid fibers.

In some embodiments the first yarns include at least 5% inherently flame resistant fibers. In further embodiments the first yarns include at least 25% inherently flame resistant fibers.

The second yarns may further include modacrylic fibers, or in some embodiments other inherently flame resistant fibers other than modacrylic fibers.

In certain embodiment the second yarns include from about 20-80% wool fibers and from about 80% to about 20% modacrylic fibers.

In further embodiments the first yarns or second yarns include sufficient inherently flame resistant fibers such that the fabric has a char length of no more than 6 inches and an afterflame of no more than 2 seconds when tested in accordance with ASTM D6413 (2008) as included in ASTM F1506-02.

In yet further embodiments the first yarns or second yarns include sufficient inherently flame resistant fibers such that the fabric has a char length of no more than 4 inches and an afterflame of no more than 2 seconds when tested in accordance with ASTM D6413 (2008) as included in NFPA 2112 (2012).

In particular embodiments the first yarns include sufficient inherently flame resistant fibers such that the fabric exhibits a thermal shrinkage of no more than 10% when tested in accordance with NFPA 2112 (2012).

In some embodiments the fabric is a plush or terry knit, and the second yarns are napped on one or both sides of the fabric to form a fleece fabric. In other embodiments, the fabric is a 2-end or 3-end knit and the second yarns are napped on one side of the fabric to form a fleece fabric.

In a particular embodiment a flame resistant fabric is a plush or terry knit construction and includes core yarns including aramid fibers and pile yarns including wool and modacrylic fibers. Further, the pile yarns on at least one side of the fabric are napped to form a fleece fabric, and the fabric has a char length of no more than 4 inches and an afterflame of no more than 2 seconds when tested in accordance with ASTM D6413 (2008) as included in NFPA 2112 (2012).

BRIEF DESCRIPTION OF THE DRAWINGS

Illustrative embodiments of the present invention are described in detail below with reference to the following drawing figures:

FIG. 1 is a flame resistant fabric having first yarns and second yarns according to an embodiment of the invention.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Embodiments of the invention relate to a flame resistant fabric having first yarns and second yarns, the first yarns including inherently flame resistant fibers, and the second yarns including wool fibers. The fabric is flame resistant. In certain embodiments, the flame resistance of the fabric may be evaluated based on performance standards set forth in one or more of ASTM F 1506-02a (Standard Performance Specification for Flame Resistant Textile Materials for Wearing Apparel for Use by Electrical Workers Exposed to Momentary Electric Arc and Related Thermal Hazards) (editorial changes made in February 2004), NFPA 70E (Standard for Electrical Safety in the Workplace) (2012) and NFPA 2112 (Flame-Resistant Garments for Protection of Industrial Personnel Against Flash Fire) (2012 Edition). These standards, and the underlying tests methods, ASTM Standards, AATCC Publications referenced therein and in this application, are incorporated by this reference in their entireties. Fabrics containing inherently flame resistant fibers and wool fibers according to embodiments of the present invention thus may have both flash fire and arc protection and the positive cold weather insulation characteristics of polyester. Further, such flame resistant fabrics may be include a combination of fibers that are flame resistant, resilient, hydrophobic and launderable.

A purely exemplary construction of a flame resistant fabric 100 according to the present invention is illustrated in FIG. 1, which shows a 3-end knit fabric in detail. Generally, the knit fabric includes first yarns 20 and optional (for a 3-end knit) tie yarns 30 which overlie and follow approximately the same paths as the first yarns 20 to form a knitted face layer. The flame resistant fabric 100 also includes second yarns 40 that extend approximately straight across the back of the first yarns 20 and tie yarns 30 except at periodic locations 50 where the second yarns 40 are tied into the fabric's technical back by the tie yarns 30.

The knit construction shown in FIG. 1 is called a 3-end knit construction. As explained below, however, other knit or non-knit constructions can be used, including a 2-end knit construction, usually produced on a weft or circular knitting machine with a sinker mechanism. 2-end knit constructions include first yarns and second yarns (i.e., not separate tie yarns 30), and if a 2-end fleece is to be made then the second yarns may be napped, usually on only one side of the fabric.

As known in the art, knitting machines used to create napped fabrics may include a sinker mechanism for incorporating nap/pile yarns, or in certain 3-end fleece constructions, a 3-end machine may also incorporate a mechanism to lay-in nap yarns (such as the second yarns 40 discussed herein) to the knit structure for napping.

In order to improve the thermal insulative performance of the fabric it may be desirable to nap fabrics formed according to the present invention to form a fleece fabric. To nap a 3-end knit fabric 100, the first yarns 20, tie yarns 30, and second yarns 40 are formed into a 3-end knit structure as set forth above. The knit fabric is then subjected to a napping operation which pulls the second yarns 40 away from the structure of the first yarns 20 and tie yarns 30 so that a napped back layer is formed. The napping operation is performed in a conventional way, such as by brushing the fabric with wires. An optional shearing process can be applied to the napped fabric to remove surface irregularities from the fabric, resulting in a smoother finished surface. The napping operation increases the bulk or thickness of the fabric without increasing the fabric weight. The napped fibers create a more insulative layer than the flat fabric. Thus, the fabric functions as a better thermal barrier without increasing the weight load on a user wearing a garment incorporating the fabric. The napping process can increase the thickness of a 3-end knit fabric by at least about 50% or more. Typically, 2-end and 3-end knit fabrics are only napped (if at all) on one side of the fabric (i.e., the side of the fabric on which the second yarns 40 are located). In contrast, plush or terry fabrics may be napped (but do not have to be) on one or both sides of the fabric. Napping both sides of a plush or terry fabric could increase the thickness of the fabric by even more than that of a 2-end or 3-end knit fabric of comparable thickness. Napped fabrics, which have improved thermal insulation performance compared to similar sized fabrics of comparable weight, may also have improved electric arc and flash fire performance.

In certain embodiments, a double-sided fleece fabric may be formed using a reverse-plating plush or terry machine. Such a fabric includes first (core/ground) yarns and second (pile) yarns. Once formed, both sides of the fabric are napped and then optionally sheared to form the double-sided fleece fabric.

In yet other embodiments, a single-sided napped fabric or fleece fabric may be formed using a regular plating plush machine or regular plating terry machine. Such a fabric also includes first (core/ground) yarns and second (pile) yarns. Once the fabric is formed, the second (pile) yarns are predominantly visible on one side of the fabric—the second yarns are napped and optionally sheared to form the single-sided fleece fabric.

In some embodiments, the second yarns 40 include wool fibers (which have some degree of natural flame resistance and excellent cold weather insulating characteristics) blended with modacrylic fibers (which are low cost and easy to dye). In some embodiments, the second yarns 40 include about 10-90% wool fibers and about 10-90% modacrylic fibers. In certain embodiments, the second yarns 40 include about 20-80% wool fibers and about 20-80% modacrylic fibers. In yet other embodiments, the second yarns 40 include about 20-70% wool fibers and about 30-80% modacrylic fibers. In particular embodiments, the second yarns 40 include about 20-60% wool fibers and about 40-80% modacrylic fibers. In further embodiments, the second yarns 40 include about 35-55% wool fibers and about 45-65% modacrylic fibers.

Other fibers may be included in the second yarns 40; however, the wool and modacrylic fibers make up the majority of fiber in the second yarns 40 in some embodiments. Such other fibers include, but are not limited to, cellulosic fibers, aramid fibers (para-aramid and/or meta-aramid), polybenzoxazole (PBO) fibers, polybenzimidazole (PBI) fibers, PyroTex® acrylic fibers (available from Pyro-Tex Fibers GmbH), nylon fibers, ultra-high density polyethylene fibers, carbon fibers, silk fibers, polyester fibers, poly{2,6-diimidazo[4,5-b:40; 50-e]-pyridinylene-1,4(2,5-dihydroxy)phenylene} ("PIPD") fibers, melamine fibers, pre-oxidized acrylic fibers, polyacrylonitrile (PAN) fibers, TANLON™ (available from Shanghai Tanlon Fiber Company), polyamide-imide fibers such as KERMEL™, polynosic rayon, polyester, polyvinyl alcohol, polytetrafluoroethylene, wool, polyvinyl chloride, polyetheretherketone, polyetherimide, polyethersulfone, polychlal, polyimide, polyamide, polyimideamide, polyolefin, glass, antistatic, and combinations thereof.

Examples of suitable modacrylic fibers are PROTEX™ fibers available from Kaneka Corporation of Osaka, Japan, SEF™ available from Solutia, TAIRYLAN fibers available from Formosa Plastics Corp. of Taipei, Taiwan, or blends thereof. Examples of cellulosic fibers include cotton, rayon, acetate, triacetate, MODAL™, and lyocell fibers (as well as their flame resistant counterparts FR cotton, FR rayon, FR acetate, FR triacetate, and FR lyocell). An example of a suitable rayon fiber is Viscose by Lenzing, available from Lenzing Fibers Corporation. Examples of lyocell fibers include TENCEL™ and TENCEL A100™, both available from Lenzing Fibers Corporation. Examples of FR rayon fibers include Lenzing FR™, also available from Lenzing Fibers Corporation, and VISIL™, available from Sateri. Examples of para-aramid fibers include KEVLAR™ (available from DuPont), TECHNORA™ (available from Teijin Twaron BV of Arnheim, Netherlands), and TWARON™ (also available from Teijin Twaron BV). Examples of meta-aramid fibers include NOMEX™ (available from DuPont), CONEX™ (available from Teijin), and APYEIL™ (available from Unitika). Examples of ultra-high density polyethylene fibers include Dyneema and Spectra. An example of a polyester fiber is VECTRAN™ (available from Kuraray). An example of a PIPD fiber includes M5 (available from Dupont). An example of melamine fiber is BASOFIL™ (available from Basofil Fibers). An example of PAN fiber is Panox® (available from the SGL Group).

In certain embodiments of the invention, the second yarns 40 may include wool fibers and inherently flame resistant fibers other than modacrylic fibers. Suitable inherently flame resistant fibers include, but are not limited to, any of the flame resistant fibers discussed above, such as but not limited to aramid fibers (para-aramid and/or meta-aramid), PBO fibers, PBI fibers, PyroTex® acrylic fibers, PIPD fibers, melamine fibers, polyamide-imide fibers, FR cellulosic fibers (including but not limited to FR cotton, FR rayon, FR acetate, FR triacetate, and FR lyocell), and combinations thereof. In some embodiments, the second yarns 40 include about 10-90% wool fibers and about 10-90% inherently flame resistant fibers. In certain embodiments, the second yarns 40 include about 20-80% wool fibers and about 20-80% inherently flame resistant fibers. In yet other embodiments, the second yarns 40 include about 20-70% wool fibers and about 30-80% inherently flame resistant fibers. In particular other embodiments, the second yarns 40 include about 20-60% wool fibers and about 40-80% inherently flame resistant fibers. In further embodiments, the second yarns 40 include about 35-55% wool fibers and about 45-65% inherently flame resistant fibers. Other fibers may be included in the second yarns 40; however, the wool and inherently flame resistant fibers make up the majority of fiber in the second yarns 40 in some embodiments. Such other fibers include, but are not limited to, any of the fibers described above, including combinations or blends thereof.

Wool fibers provide good pile support, which minimizes matting in the pile. It is possible that protein fiber wool fibers may be used in the second yarns 40, but it may be beneficial to use at least some Superwash wool fibers for better laundry shrinkage control in addition to, or in the alternative to, wool protein fibers. In addition, flame-resistant treated wool (FR treated wool) fibers may be used in the second yarns 40 in addition to, or in the alternative to, the other wool fibers discussed above.

Wool is also a durable fiber and will impart abrasion resistance to the fabric. When included in the second yarns 40, other inherently flame resistant fibers, and in particular modacrylic fibers, impart thermal resistance to the second yarns 40, which can help the fabric satisfy the requirements of one or more of the performance standards discussed above. In particular, the inclusion of modacrylic fibers in the second yarns 40 or generally in the fabric 100 may help control afterflame in the fabric, as yarns including only wool fibers may not have enough thermal stability to provide sufficient afterflame performance.

As discussed, the first yarns 20 include inherently flame resistant fibers. In a knit fabric, the inherently flame resistant fibers in the first yarns 20 generally have a predominant effect on the char length of fabrics formed according to the present invention. In addition, inherently flame resistant fibers in the first yarns 20 help minimize thermal shrinkage of the fabric. Suitable inherently flame resistant fibers for use in the first yarns 20 include, but are not limited to, aramid fibers (para-aramid and/or meta-aramid), PBO fibers, PBI fibers, PyroTex® acrylic fibers, PIPD fibers, melamine fibers, polyamide-imide fibers, modacrylic fibers, FR cellulosic fibers (including but not limited to FR cotton, FR rayon, FR acetate, FR triacetate, and FR lyocell) and combinations thereof. In some embodiments, the first yarns 20 include aramid fibers.

In some embodiments, the first yarns 20 include at least about 5% inherently flame resistant fibers, or at least about 10% inherently flame resistant fibers, or at least about 15% inherently flame resistant fibers, or at least about 20% inherently flame resistant fibers, or at least about 25% inherently flame resistant fibers, or at least about 30% inherently flame resistant fibers, or at least about 35% inherently flame resistant fibers, or at least about 40% inherently flame resistant fibers, or at least about 45% inherently flame resistant fibers, or at least about 50% inherently flame resistant fibers, or at least about 55% inherently flame resistant fibers, or at least about 60% inherently flame resistant fibers, or at least about 65% inherently flame resistant fibers, or at least about 70% inherently flame resistant fibers, or even at least about 75% inherently flame resistant fibers.

Other fibers may be included in the first yarns 20, including, but not limited to, any of the fibers described above, including combinations or blends thereof. In particular embodiments, the first yarns 20 may include blends of aramid fibers and lyocell fibers, or blends of aramid, lyocell and modacrylic fibers.

Tie yarns 30, if included in the fabric 100, may include any of the fibers described above. As discussed, however, in a 3-end fabric 100 such as that described above the tie yarns 30 are placed alongside the first yarns 20. Accordingly, in such constructions it may be desirable for the tie yarns 30 to have comparable fiber blends and amounts as those of the first yarns 20.

In some embodiments, the first yarns 20 and second yarns 40 (and tie yarns 30 if included) may all have the same fiber blends. In other words, the first yarns 20 and optional tie yarns 30 may include inherently flame resistant fibers (such as aramid fibers) as discussed above and may also include other fibers, such as wool and modacrylic fibers. Further, the second yarns 40 may include wool and modacrylic fibers as discussed above and may also include other fibers, such as aramid fibers. Thus, all of the yarns in the fabric 100 could have identical fiber blends. The first yarns 20 and second yarns 40 could have different amounts of the same fiber blends (e.g., 50/40/10 para-aramid/modacrylic/wool in the first yarns 20 and 10/30/60 para-aramid/modacrylic/wool in the second yarns 40), or could include identical amounts of the same fiber blends.

Embodiments of the invention could also be described with reference to the total content of wool and inherently flame resistant fibers in the fabric. For example, in some embodiments the total content of wool fibers and inherently flame resistant fibers in the fabric is at least about 20% collectively. In certain embodiments, the total content of wool fibers and inherently flame resistant fibers in the fabric is at least about 25% collectively, or at least about 30% collectively, or at least about 35% collectively, or at least about 40% collectively, or at least about 45% collectively, or at least about 50% collectively, or at least about 55% collectively, or at least about 60% collectively, or at least about 65% collectively, or at least about 70% collectively, or at least about 75% collectively, or at least about 80% collectively. The inherently flame resistant fibers may include, but are not limited to, one or more of the inherently flame resistant fibers described above, for example modacrylic fibers, or a combination of modacrylic fibers and aramid fibers. Thus, in a particular embodiment the fabric may have a total content of wool and modacrylic fibers of at least about 40% collectively. In another exemplary embodiment the fabric may have a total content of wool, modacrylic and aramid fibers of at least about 50% collectively.

In some embodiments it may be possible for the second yarns 40 to include wool fibers and no other inherently flame resistant fibers, and for the entire content of inherently flame resistant fibers in the fabric to be located in the first yarns 20 and other optional yarns (if present). For example, the second yarns 40 could include only wool fibers, or include only wool fibers and non-inherently flame resistant fibers (such as, but not limited to, one or more of nylon, polyester, lyocell and/or antistatic fibers), and the first yarns 20 could include inherently flame resistant fibers such as modacrylic fibers and aramid fibers and optionally other non-inherently flame resistant fibers such as lyocell fibers.

The content of wool fibers in the second yarns 40 and inherently flame resistant fibers (e.g., modacrylic fibers) in the second yarns 40 and/or first yarns 20 can be described by the physical properties of the fabric that the fibers impart to the resulting fabric, as different fabric constructions may require more or less of a particular fiber type or amount in order for the fabric to have a desired physical property so that it satisfies a particular performance standard. In some embodiments, for example, the first yarns 20 and/or second yarns 40 include sufficient inherently flame resistant fibers such that the fabric has a char length of no more than 6 inches and an afterflame of no more than 2 seconds when tested in accordance with ASTM D6413 (2008) as included in ASTM F1506. In other embodiments, the first yarns 20 and/or second yarns 40 include sufficient inherently flame resistant fibers such that the fabric has a char length of no more than 4 inches and an afterflame of no more than 2 seconds when tested in accordance with ASTM D6413 (2008) as included in NFPA 2112 (2012). In yet other embodiments, the first yarns 20 include sufficient inherently flame resistant fibers such that the fabric exhibits a thermal shrinkage of no more than 10% when tested in accordance with NFPA 2112 (2012). The NFPA 2112 standard is generally a more stringent standard than that of ASTM F1506, as the char length requirement for NFPA 2112 is more restrictive (no more than 4 inches) and NFPA 2112 includes a thermal shrinkage standard that ASTM F1506 lacks.

The first yarns 20, second yarns 40, and/or tie yarns 30 or other optional yarns may be formed of staple fibers, filament fibers, stretch-broken fibers, or combinations of these fibers. In addition, the first yarns 20 and/or second yarns 40 may be plied and/or covered (i.e., wrapped) with additional spun/filament/stretch-broken yarns to form plied or covered yarns. Further, if the first yarns 20 and/or second yarns 40 are formed of filament fibers, the yarns may be formed of mixed multi-filaments (e.g., para-aramid filament and modacrylic filament). In certain embodiments, the first yarns 20 and optional tie yarns 30 could include elastomeric or stretch yarns plied, covered or otherwise combined with yarns containing the inherently flame resistant fibers.

In some embodiments, the flame resistant fabric has a weight of about 5 to about 16 oz/yd$^2$.

While a 3-end knit fabric, and specifically a 3-end knit fleece fabric, is specifically discussed above and more generally 2-end knit fabrics, 2-end knit fleece fabrics, and plush/terry fabrics are described, it will be understood that other fabric constructions are within the scope of the present invention. For example, fabrics according to the invention could have various knit constructions, including but not limited to a single-sided fleece, double-sided fleece, weft knit construction, a warp knit construction, a circular knit construction, a single face knit construction and a double face knit construction. Further, while at least one surface of the fabric may be (but does not have to be) napped, the surface could also be finished in the form selected from the group consisting of: pile, shearling, velour and loop terry. In some cases, the textile fabric is a pile fabric having woven or double needle bar Rachel warp knit construction. Moreover, knit fabrics according the invention could be formed on any type of suitable machine, including but not limited to a reverse-plating plush or terry machine, a regular-plating plush or terry machine, a 2-end knitting machine and a 3-end knitting machine.

Further, the present invention need not be limited to knit fabrics. For example, in some embodiments fabrics according to the present invention may be woven fabrics having first yarns including inherently flame resistant fibers in the yarns of, e.g., one of the warp or filling direction and second yarns including wool fibers in the yarns of the other of the filling or the warp direction. The fabric may be woven according to known weaving methods, including one or more of a twill (e.g., 1×1, 2×1, 3×1, etc.), satin or sateen weave. Further, the fabric may be of one or more of flannel, velvet or velour. It may be particularly desirable to weave the fabric so that more of the first yarns containing inherently flame resistant fibers are predominantly located on one side of the fabric and the second yarns containing the wool fibers are predominantly located on the other side of the fabric. One purely exemplary way to accomplish this would be to weave the fabric in a 2×1 or greater (e.g., 3×1, 4×1, etc.) twill configuration. Then, if desired, the side of the fabric with the second yarns containing wool fibers located primarily thereon could be napped or otherwise finished by known methods to provide a similar result as that of the 3-end knit fabric described above. In such an embodiment, it may be further desirable for the first yarns to have a higher yarn count or smaller denier (i.e., have a smaller diameter) than those of the second yarns, so that the first yarns will be less exposed on the side of the fabric on which the second yarns are predominantly located and to which the additional optional finishing process is applied. This will protect the first yarns from damage during the finishing process.

In other embodiments, the first yarns and second yarns may be woven in both the filling and warp directions, and then optionally napped or otherwise finished on one or both sides of the fabric as desired. It may be desirable, as discussed above, for the first yarns to have a higher yarn count or smaller denier (i.e., have a smaller diameter) than those of the second yarns, so that the first yarns will be protected from damage during the napping/finishing process.

In yet other embodiments, fabrics according to the present invention may be nonwoven fabrics having inherently flame resistant fibers in the scrim (i.e., "first yarns") and wool fibers in the needlepunched pile blend (i.e., "second yarns"). The pile blend containing wool fibers may be finished according to known nonwoven finishing processes to achieve similar results as the napping process described above. Woven and/or nonwoven fabrics including first yarns including inherently flame resistant fibers and second yarns including wool fibers according to the present disclosure may satisfy one or more performance standards set forth in one or more of ASTM F 1506-02a, NFPA 70E and NFPA 2112.

Embodiments of the invention may be further described with reference to the following non-limiting examples.

Example 1

Plush/terry fleece knit fabrics according to the present invention were formed from spun yarns having the following yarn content and with the following fabric properties. The fabric samples were napped on both sides:

| | Sample | | | | | |
|---|---|---|---|---|---|---|
| | A | B | C | D | E | F |
| Second/ Pile yarns | 55% wool; 45% mod | 35% wool; 65% mod | 35% wool; 65% mod | 35% wool; 65% mod | 35% wool; 65% mod | 55% wool; 45% mod |
| First/ Core yarns | 35% mod; 30% lyocell; 35% aramid | 35% mod; 30% lyocell; 35% aramid | 35% mod; 30% lyocell; 35% aramid | 35% mod; 30% lyocell; 35% aramid | 35% mod; 30% lyocell; 35% aramid | 48% mod; 37% lyocell; 15% aramid |
| Weight (osy) | 10.0 | 9.5 | 11.8 | 9.6 | 10.4 | 8.5 |
| Width (in) | 58.7 | 59.9 | 59.9 | 59.1 | 57.9 | 60.9 |

mod = modacrylic

The fabric samples were tested against various performance standards as set forth below:

| | Sample | | | | | |
|---|---|---|---|---|---|---|
| | A | B | C | D | E | F |
| Vertical flame (BW): | | | | | | |
| afterflame (s, W/C) | 0, 0 | 0, 0 | 0, 0 | 0, 0 | 0, 0 | 0, 0 |
| afterglow (s, W/C) | 4.3, 5.3 | 5.7, 5.5 | 5.9, 6.1 | 5.7, 5.1 | 4.7, 5.5 | 13, 15.2 |
| char length (in, W/C) | 1.6, 0.8 | 1.2, 2.6 | 0.7, 1.8 | 2.4, 2.3 | 1.2, 1.9 | 2.9, 3.1 |
| Laundry shrinkage: 120 PP, 5x (%) | | | | | | |
| W | 8.0 | 6.1 | 4.3 | 8.3 | 5.9 | 5.9 |
| C | −5.0 | −1.2 | 4.0 | −2.5 | 0.7 | 1.2 |
| 140 CS, 5x (%) | | | | | | |
| W | 10.0 | 8.4 | 5.2 | 10.1 | 1.7 | 6.5 |
| C | −8.5 | −3.7 | 5.3 | −4.5 | 0.7 | −4.0 |
| Mullen Burst (BW) (psi) | 85 | 78 | 87 | 83 | 85 | 79 |
| Ball Burst (BW) (lb) | 55.6 | 45.1 | 55.7 | 49.8 | 53.9 | 41.4 |
| Air permeability (BW) (cfm/ft$^2$) | 211 | 201 | 146 | 210 | 178 | 258 |
| Colorfastness: Laundering (2A) | | | | | | |
| Shade rating | 4-5 | 4-5 | 4-5 | 4-5 | 4-5 | 4-5 |
| Staining rating | 4 | 4 | 4 | 4 | 4 | 4-5 |

W/C = wales and course directions of knit fabric

BW = before washing;

5x = after 5 launderings as tested in accordance with AATCC 135 (2004)

Vertical flame tested in accordance with ASTM D6413 (2008)

Laundry shrinkage tests: 120 degrees Permanent Press and 140 degrees Cotton Sturdy (tested in accordance with AATCC 135 (2004))

Mullen Burst tested in accordance with ASTM D3786/D3786M-09 (2009)

Ball Burst tested in accordance with ASTM D3787-07 (2011)

Air Permeability tested in accordance with ASTM D737-04 (2012)

Colorfastness tested in accordance with AATCC test method 61-2010 (2010)

These fabrics were thus tested against several of the required performance standards for flame resistant textile materials for use by electrical workers exposed to electrical arc and related thermal hazards specified by ASTM F1506-02a. The performance standards for knit fabrics having a weight of 8.1-16.0 osy include the following:

| | |
|---|---|
| Burst strength (per ASTM D3786) | 60 psi min. |
| Laundering shade change (per AATCC Method 61, IIA) | Class 3 min. |
| Initial flammability (per ASTM D6413): | |
| Char length | 6 in. max. |
| Afterflame | 2 sec. max. |
| Flammability after 25 washes (per ASTM D6413): | |
| Char length | 6 in. max. |
| Afterflame | 2 sec. max. |
| Arc test results (per ASTM F1959): | |
| Afterflame | 5 sec. max. |

The fabrics of Samples A-F above passed at least the burst strength, laundering shade change and initial flammability performance standards. Further, although the samples were not specifically tested for afterwash flammability and arc test performance, in view of the superior pre-laundering char length and afterflame performance and the weight and loft of the fabrics, it is apparent that these fabrics would satisfy the after wash and arc test requirements of ASTM F1506. Further, it is believed that these fabrics would satisfy the performance requirement for a Hazard Risk Category II ("HRC II") (ATPV≥8) fabric as specified in NFPA 70E (2012). In addition, one or more of these fabrics may also satisfy the performance standard specified by NFPA 2112 (2012). In fact, Sample A was tested for arc thermal protective value (ATPV) in accordance with ASTM F1506, and achieved an ATPV of 23 cal/cm$^2$, which exceeds the minimum requirement of 8 for an HRC II fabric under NFPA 70E.

Example 2

Plush/terry fleece knit fabrics according to the present invention were formed from spun yarns having the following yarn content and with the following fabric properties. The fabric samples were napped on both sides:

| | Sample | | |
|---|---|---|---|
| | G | H | I |
| Second/ Pile yarns | 49% wool; 49% modacrylic; 2% antistatic | 49% wool; 49% modacrylic; 2% antistatic | 49% wool; 49% modacrylic; 2% antistatic |
| First/ Core yarns | 25% lyocell; 75% aramid | 25% modacrylic; 25% lyocell; 50% aramid | 35% modacrylic; 30% lyocell; 35% aramid |
| Weight (osy) | 10.3 | 10.5 | 10.6 |

The fabric samples were tested against various performance standards as set forth below:

| | Sample | | |
|---|---|---|---|
| | G | H | I |
| Vertical flame (BW): | | | |
| afterflame (s, W/C) | 0, 0 | 0, 0 | 0, 0 |
| char length (in, W/C) | 0.2, 0.2 | 0.2, 0.23 | 0.8, 0.4 |
| Vertical flame (100 IL): | | | |
| afterflame (s, W/C) | 0, 0 | 0, 0 | 0, 0 |
| char length (in, W/C) | 0.5, 0.46 | 1.5, 1.5 | 1.3, 2.3 |

-continued

| | Sample | | |
|---|---|---|---|
| | G | H | I |
| Laundry shrinkage: | | | |
| 120 PP, 5x, W/C (%) | 5.4, 1.9 | 4.7, 0.4 | 3.9, 0.8 |
| Mullen Burst (BW) (psi) | 88 | 73 | 68 |
| Ball Burst (BW) (lb) | 68 | 59 | 51 |
| Air permeability (BW) (cfm/ft$^2$) | 180 | 181 | 180 |
| Colorfastness: | | | |
| Laundering (2A) | | | |
| Rating (shade) | 5 | 5 | 4-5 |
| Rating (staining) | 4-5 | 4-5 | 4-5 |

W/C = wales and course directions of knit fabric
BW = before washing;
5x = after 5 launderings as tested in accordance with AATCC 135 (2004)
Vertical flame tested in accordance with ASTM D6413 (2008) 100 IL = 100 industrial launderings (wash method specified by NFPA 2112)
Laundry shrinkage tests: 120 degrees Permanent Press (tested in accordance with AATCC 135 (2004))
Mullen Burst tested in accordance with ASTM D3786/D3786M-09
Ball Burst tested in accordance with ASTM D3787-07 (2011)
Air Permeability tested in accordance with ASTM D737-04 (2012)
Colorfastness tested in accordance with AATCC test method 61-2010 (2010)

These fabrics were thus tested against several of the required performance standards for flame resistant textile materials for use by electrical workers exposed to electrical arc and related thermal hazards specified by ASTM F1506-02a (2004), which are set forth above in Example 1.

The fabrics of Samples G, H and I above passed at least the burst strength, laundering shade change, initial flammability performance, and flammability after 25 wash standards (they passed after 100 launderings and therefore passed after 25 launderings). Further, although the samples were not specifically tested for arc test performance, in view of the superior pre-laundering and post-laundering char length and afterflame performance and the weight and loft of the fabrics, it is apparent that these fabrics would satisfy the arc testing requirements of ASTM F1506. It is believed that these fabrics would satisfy the performance requirement for a HRC II fabric as specified in NFPA 70E (2012). In fact, a finished fabric corresponding to Sample H was produced and tested for arc thermal protective value (ATPV) in accordance with ASTM F1506, and achieved an ATPV of 23 cal/cm$^2$, which exceeds the minimum requirement of 8 for an HRC II fabric under NFPA 70E.

In addition, the fabrics of Samples G, H and I had a thermal shrinkage of less than 10% and thus satisfied the thermal shrinkage requirements of NFPA 2112. Further, as noted above each of these fabrics had a char length of less than 4 inches and an afterflame of less than 2 seconds before and after 100 Industrial Launderings. Each of these fabrics thus satisfied the requirements of NFPA 2112 (2012). It is also believed that these fabrics may satisfy the standard specified by NFPA 70E (2012).

Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the claims below.

That which is claimed is:

1. A flame resistant fabric comprising first yarns, second yarns, and at least one fleece side, wherein:

a. the first yarns comprise a first fiber blend comprising a blend of modacrylic, aramid, and lyocell fibers;

b. the modacrylic and aramid fibers of the first fiber blend comprise at least 25% of the first fiber blend;

c. the first fiber blend is devoid of wool fibers;

d. the second yarns comprise a second fiber blend that is different from the first fiber blend;

e. the second fiber blend comprises from about 20-60% wool fibers and from about 40-80% modacrylic fibers;

f. the second yarns are pulled away from the first yarns in a napping operation to form the at least one fleece side;

g. the wool and modacrylic fibers of the second fiber blend together comprise a majority of fibers in the second fiber blend;

h. the fabric exhibits a thermal shrinkage of no more than 10% when tested in accordance with NFPA 2112 (2012); and i. the fabric has a char length of no more than 6 inches and an afterflame of no more than 2 seconds when tested in accordance with ASTM D6413 (2008).

2. A flame resistant fabric comprising first yarns, second yarns, and at least one fleece side, wherein:

a. the first yarns comprise a first fiber blend comprising a blend of modacrylic, aramid, and lyocell fibers;

b. the modacrylic and aramid fibers of the first fiber blend comprise at least 50% of the first fiber blend;

c. the first fiber blend is devoid of wool fibers;

d. the second yarns comprise a second fiber blend that is different from the first fiber blend;

e. the second fiber blend comprises from about 10-90% wool fibers, from about 45-65% modacrylic fibers, and lyocell fibers;

f. the second yarns are pulled away from the first yarns in a napping operation to form the at least one fleece side;

g. the wool and modacrylic fibers of the second fiber blend together comprise a majority of fibers in the second fiber blend;

h. the fabric exhibits a thermal shrinkage of no more than 10% when tested in accordance with NFPA 2112 (2012); and i. the fabric has a char length of no more than 6 inches and an afterflame of no more than 2 seconds when tested in accordance with ASTM D6413 (2008).

* * * * *